US009279201B2

(12) United States Patent
Akita

(10) Patent No.: US 9,279,201 B2
(45) Date of Patent: Mar. 8, 2016

(54) ELASTIC WARP KNITTED FABRIC

(75) Inventor: Shoichi Akita, Tokyo (JP)

(73) Assignee: ASAHI KASEI FIBERS CORPORATION, Osaka-Shi (JP)

( * ) Notice: Subject to any disclaimer, the term of this patent is extended or adjusted under 35 U.S.C. 154(b) by 613 days.

(21) Appl. No.: 13/514,111

(22) PCT Filed: Aug. 30, 2010

(86) PCT No.: PCT/JP2010/064731
§ 371 (c)(1),
(2), (4) Date: Jun. 6, 2012

(87) PCT Pub. No.: WO2011/070828
PCT Pub. Date: Jun. 16, 2011

(65) Prior Publication Data

US 2012/0244773 A1 Sep. 27, 2012

(30) Foreign Application Priority Data

Dec. 7, 2009 (JP) ..... 2009-277625

(51) Int. Cl.
*D04B 21/18* (2006.01)

(52) U.S. Cl.
CPC ..... *D04B 21/18* (2013.01); *Y10T 442/413* (2015.04)

(58) Field of Classification Search
CPC ..... D04B 21/18; D04B 23/16; Y10T 442/413
USPC ..... 66/195, 192, 193
See application file for complete search history.

(56) References Cited

U.S. PATENT DOCUMENTS

| | | | | |
|---|---|---|---|---|
| 3,910,075 | A | | 10/1975 | Holliday |
| 4,173,131 | A | * | 11/1979 | Pendergrass et al. ..... 602/76 |
| 4,298,643 | A | * | 11/1981 | Miyagawa et al. ..... 428/85 |
| 4,649,722 | A | | 3/1987 | Gajjar |

(Continued)

FOREIGN PATENT DOCUMENTS

| | | | |
|---|---|---|---|
| EP | 1 281 798 | A2 | 2/2003 |
| EP | 1 350 879 | A1 | 10/2003 |

(Continued)

OTHER PUBLICATIONS

Office Action for corresponding CN Patent Application No. 201080055534.4 mailed May 28, 2013.

(Continued)

*Primary Examiner* — Danny Worrell
(74) *Attorney, Agent, or Firm* — Finnegan, Henderson, Farabow, Garrett & Dunner, L.L.P.

(57) ABSTRACT

An elastic warp knitted fabric which exhibits excellent extensibility and extension recovery characteristics and gives good wearing feeling, has excellent motion followability, can contribute to improvement in movement function, further has no limitation in applications due to extension force thereof, and can be used as the material of a garment less likely to lose the shape due to wearing. The elastic warp knitted fabric of the present invention is the elastic warp knitted fabric knitted at least two guide bars, and is characterized in that the elastic fibers are arranged on at least one guide bar and inelastic fibers are arranged on the other guide bar, respectively, both an extension force in the warp direction and that in the weft direction are 100 cN to 600 cN, in extension by 80% of the said knitted fabric, that the ratio of the extension force in the warp direction to that in the weft direction is 0.8 to 1.8.

9 Claims, 5 Drawing Sheets

(56) References Cited

U.S. PATENT DOCUMENTS

| | | | | |
|---|---|---|---|---|
| 4,802,346 | A * | 2/1989 | Gajjar | 66/195 |
| 5,029,457 | A * | 7/1991 | Gajjar | 66/195 |
| 5,250,351 | A * | 10/1993 | Kondou et al. | 442/306 |
| 5,256,134 | A * | 10/1993 | Ingham | 602/8 |
| 5,403,267 | A * | 4/1995 | Pearce et al. | 602/8 |
| 5,596,888 | A * | 1/1997 | McLarty et al. | 66/195 |
| 6,223,782 | B1 * | 5/2001 | Watkins | 139/383 R |
| 6,401,497 | B1 * | 6/2002 | Nishiyama et al. | 66/172 E |
| 6,766,669 | B1 * | 7/2004 | Tung | 66/195 |
| 6,845,639 | B1 * | 1/2005 | Hajek | 66/195 |
| 6,912,877 | B2 * | 7/2005 | Yokoyama et al. | 66/195 |
| 7,201,024 | B2 * | 4/2007 | Hirayama et al. | 66/192 |
| 2003/0051512 | A1 | 3/2003 | Pierelli | |
| 2004/0237597 | A1 * | 12/2004 | Oya et al. | 66/195 |

FOREIGN PATENT DOCUMENTS

| | | | |
|---|---|---|---|
| GB | 2 233 676 | A | 1/1991 |
| JP | 08-158217 | A | 6/1996 |
| JP | 2000-314063 | A | 11/2000 |
| JP | 2006-265785 | A | 10/2006 |
| JP | 2007-138362 | | 6/2007 |
| JP | 2003-129361 | | 5/2008 |
| JP | 2010-189815 | | 9/2010 |
| TW | I251630 | | 3/1995 |

OTHER PUBLICATIONS

Taiwanese Office Action dated Nov. 15, 2012, issued in corresponding Taiwanese Application 099129326, 5 pages.

English-language International Search Report from the Japanese Patent Office mailed Sep. 21, 2010, for International Application No. PCT/JP2010/064731.

Office Action for corresponding JP Patent Application No. 2011-545107 mailed Aug. 26, 2014.

Supplementary European Search Report in corresponding European Patent Application No. EP 10 83 5750 dated Nov. 7, 2014.

Office Action for corresponding JP Patent Application No. 2014-182698 mailed Aug. 25, 2015.

* cited by examiner

ELASTIC WARP KNITTED FABRIC

TECHNICAL FIELD

The present invention relates to an elastic warp knitted fabric superior in extensibility and extension recovery characteristics, which is thus usable as an innerwear, a sportswear, a swimsuit or the like.

BACKGROUND ART

Conventionally, an elastic warp knitted fabric containing elastic yarns has been used in many applications as an innerwear fitted to a body such as shorts, girdle, and brassiere, an undershirt fitted to a body such as sportswear, and a swimsuit, or the like. The inner wear where the warp knitted fabric is used has good wearing feeling and is also capable of enhancing shape retaining properties of body.

Further, as a sportswear or a swimsuit using these elastic warp knitted fabrics, various products have been sold aiming at enhancing body function owing to tightening action. As a tricot warp knitted fabric used in these products, a tricot 2-way warp knitted fabric has been used widely, which is composed of a half texture obtained by knitting a base texture with a knit texture of 1-0/2-3 using inelastic fibers composed of synthetic fiber multi-filaments or spun yarns such as cotton yarns, and combining to this base texture a knit texture of 1-2/1-0 using elastic fibers. This tricot 2-way warp knitted fabric has been dissatisfactory in fit feeling in wearing as a product, because of extremely little extension in a weft direction compared to that in a warp direction, although cloth extends in a weft direction and a warp direction.

In addition, in a knitted fabric having such largely different extensibility to a warp direction and a weft direction, there is also a problem of receiving large restriction in usage of cloth, because of requiring to cut cloth by matching a stress-receiving direction in practical wearing of a garment, and a direction in which cloth easily extends.

To solve this problem, there has been proposed a method for making extension stress in a warp direction and a weft direction relatively the same level, by knitting elastic yarns by two needle stitch to attain predetermined density in a course direction, aiming at fulfilling suitable balance of extensibility and extension recovery characteristics, in both of a warp direction and a weft direction, however, it has not referred at all to a knitting method of the inelastic fibers which determines extension recovery characteristics of the elastic fibers, which thus left a problem of being insufficient in motion followability arising from recovery characteristics when used as a garment (see PATENT DOCUMENT 1 below). In addition, there has been proposed a method for matching extensibility in a warp and weft to relatively same level, by knitting with a weft knit texture formed a loop by elastic yarns, or knitting by inserting elastic yarns to a base texture, however, this method only provides such one as requiring large force for extension, which limits applications, and thus has a problem of being not suitable for applications requiring extension by relatively small force, such as shorts, inner wears, sports undershirts (see PATENT DOCUMENT 2 below).

As an elastic warp knitted fabric having low stress in extension, an extension force ratio in a warp direction/in a weft direction within a certain range, and superior balance of elastic characteristics in weft and warp directions, such an elastic warp knitted fabric has also been disclosed that both of elastic yarns and inelastic yarns are composed of a specific Atlas knit texture (see PATENT DOCUMENT 3 below). This method gives a softly stretchable elastic warp knitted fabric not giving tight feeling in wearing, by decreasing stress in extension, however, it decreases extension recovery characteristics, which raises a problem of generation of losing shape at wearing, in sports goods aiming at enhancement of body function, or a problem of inhibiting motion caused by non integration of cloth and muscle movement due to poor motion followability.

In recent years, it has been required such cloth as not only simply stretching with matching to body movement but also having extension function like supporting body movement. Specifically, it has been required such a garment or a knitted fabric for a garment that is good in tightening feeling (or fit feeling), as well as extremely superior in motion followability and supports muscle or the like of a body and contributes to enhancement of movement function, by being capable of moving in nearly the same way as body movement, and still more has no limitation in applications due to extension force, and is less likely to lose shape due to wearing. However, it has been difficult to obtain a garment superior in soft stretching characteristics providing extension under low stress, and extension recovery characteristics enabling to follow extension recovery motion, by using the aforesaid knitted fabric.

PRIOR ART REFERENCES

Patent Documents

PATENT DOCUMENT 1: JP-A-7-70894
PATENT DOCUMENT 2: JP-A-6-2252
PATENT DOCUMENT 3: JP No. 3897150

SUMMARY OF THE INVENTION

Problems to be Solved by the Invention

Problems to be solved by the present invention are to solve the above-described conventional technical problems and to provide an elastic warp knitted fabric superior in extensibility and extension recovery characteristics, or motion followability and good wearing feeling, suitable for an innerwear, a sportswear, a swimsuit or the like.

Means for Solving the Problems

The present inventors have intensively studied a way to solve the above-described problems, and as a result of repeated experiments on knitted fabrics with a new structure or wearing test, have completed the present invention.

That is, the present invention encompasses the following aspects.

[1] An elastic warp knitted fabric knitted using at least two sheets of guide bars, characterized in that the elastic fibers are arranged on at least one guide bar and inelastic fibers are arranged on the other guide bar, respectively, both an extension force in the warp direction and that in the weft direction are 100 cN to 600 cN, in extension by 80% of the said knitted fabric, and that the ratio of the extension force in the warp direction to that in the weft direction is 0.8 to 1.8, and also that both extension recovery percentage in the warp direction and that in the weft direction, after extension and recovery by 80% are repeated three times, are 85% or more.

[2] The elastic warp knitted fabric according to the aspect [1], wherein the elastic fibers are threaded through a guide bar ire full-set to form a loop.

[3] The elastic warp knitted fabric according to the aspect [2], wherein inclination of a stitch of the inelastic fibers is 20 to 70 degree.

[4] The elastic warp knitted fabric knitted using three guide bars according to any one of the aspects [1] to [3], wherein the elastic warp knitted fabric is knitted using three guide bars, elastic fibers are threaded through one guide bar, and inelastic fibers are threaded through the other guide bars, in a positional relation to complement threaded positions thereof each other, in 1-in, 1-out, respectively.

[5] The elastic warp knitted fabric according to the aspect [4], wherein a texture of a guide bar where the elastic fibers are threaded through is the Denbigh texture, and a texture of either of guide bars where the inelastic fibers are threaded through is a plain cord texture with the same direction relative to the texture of the guide bar where the elastic fibers are threaded through, and a texture of other guide bars is a plain cord texture with different direction relative to the texture of the guide bar where the elastic fibers are threaded through.

[6] The elastic warp knitted fabric according to the aspect [4], wherein a texture of a guide bar where the elastic fibers are threaded through is a two needle stitched texture knitted in a zigzag way in a course direction, a texture of either of guide bars where the inelastic fibers are threaded through is a plain cord texture with the same direction relative to the texture of the guide bar where the elastic fibers are threaded through, and a texture of other guide bars is a plain cord texture with different direction relative to the texture of the guide bar where the elastic fibers are threaded through.

[7] The elastic warp knitted fabric according to any one of the aspects [1] to [3], wherein at least one kind of the inelastic fibers is knitted course by course, by reciprocating in Atlas knitting over 5 wales by two needle swing.

[8] The elastic warp knitted fabric knitted using three bars according to the aspect [7], wherein the elastic warp knitted fabric is knitted using three guide bars, the elastic fibers in one guide bar are knitted course by course, by reciprocating in Atlas knitting over 3 wales by one needle swing, the inelastic fibers in a second guide bar are knitted course by course, by reciprocating in Atlas knitting over 5 wales by two needle swing, in the same direction as the elastic fibers, and the inelastic fibers in the remaining guide bar are knitted course by course, by reciprocating in Atlas knitting over 5 wales by two needle swing in a different direction from the inelastic fibers.

[9] The elastic warp knitted fabric knitted using three guide bars according to the aspect [7], wherein the elastic warp knitted fabric is knitted using three guide bars, the elastic fibers in one guide bar are knitted by two needle stitched texture in a zigzag way in a course direction, the inelastic fibers in a second guide bar are knitted course by course, by reciprocating in Atlas knitting over 5 wales by two needle swing, and the inelastic fibers in the remaining guide bar are knitted course by course, by reciprocating in Atlas knitting over 5 wales by two needle swing in a different direction from the inelastic fibers.

EFFECTS OF THE INVENTION

When the cloth is extended with following the movement of a human body in an extending direction, stress in the extending direction and stress of cloth in a peripheral direction of a human body largely influence on wearing feeling, however, the elastic warp knitted fabric of the present invention is superior in motion followability or detachability and comfortableness in wearing, because of having predetermined extension in both of a warp direction and a weft direction of the knitted fabric, and being good instantaneous recovery characteristics. In addition, due to suppression of unnecessary extension percentage of cloth, durability of cloth can be enhanced.

EMBODIMENTS FOR CARRYING OUT THE INVENTION

Figure 1:
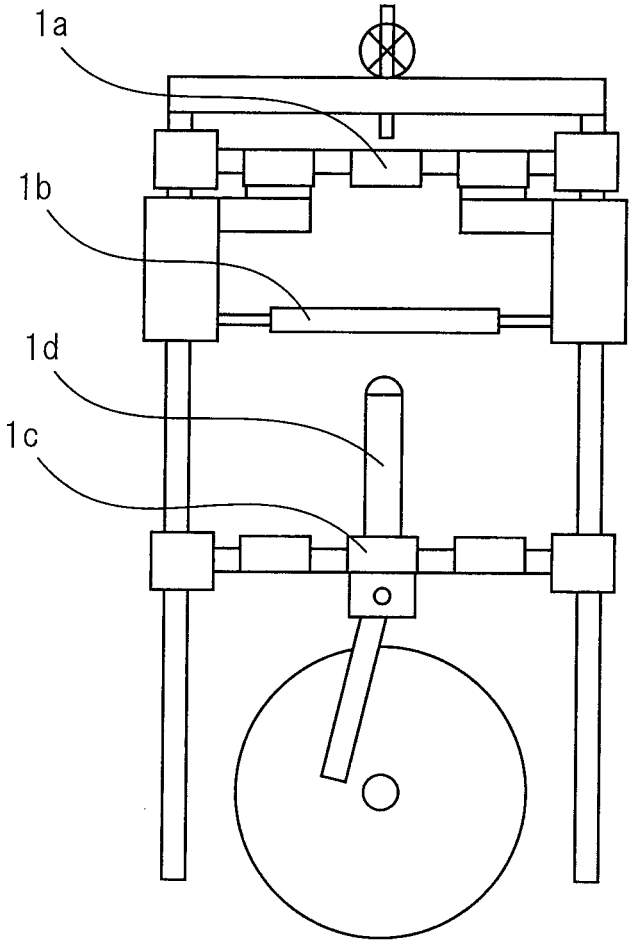
FIG. 1 is an evaluation apparatus of extension recovery characteristics of an elastic warp knitted fabric of the present invention.

Hereinafter, explanation will be given in detail on the present invention.

The elastic warp knitted fabric of the present invention is characterized by using the elastic fibers and the inelastic fibers.

The inelastic fibers to be used in the present invention may be any of a filament yarn or a spun yarn. Specifically, the filament yarn is preferably the one composed of chemical synthetic fiber such as Rayon, acetate fiber, polyamide-based fiber, polyester-based fiber, acryl-based fiber, polypropylene-based fiber, polyvinyl chloride-based fiber. A form of the filament yarn may be any of an original yarn (a non-textured yarn), a false twisting yarn, a dyed yarn or the like, and also may be a composite yarn thereof.

As the spun yarn, the one composed of natural fiber such as cotton, wool, hemp, or chemical synthetic fiber such as Rayon, acetate fiber, polyamide-based fiber, polyester-based fiber, acryl-based fiber, polypropylene-based fiber, polyvinyl chloride-based fiber is preferable, and they may be a single yarn or a mixed spun yarn or the like, or either.

That is, a suitable material may be selected as appropriate depending on applications. In addition, denier or single yarn number is not especially limited, and denier or single yarn number suitable for applications, or gage of a knitting machine to be used may be selected.

As the elastic fibers, it may be polyurethane elastic yarn, polyether-ester elastic yarn, polyamide elastic yarn, polyolefin elastic yarn, or such one as in a covered state obtained by covering these with inelastic fiber. Still more, a string-like one composed of natural rubber, synthetic rubber, semi-synthetic rubber or the like, what is called rubber thread or the like, may also be used, however, polyurethane elastic yarn which is superior in elastic characteristics and has been used widely, in general, is suitable. Also as for the elastic fibers, denier or single yarn number is not especially limited, and denier or single yarn number suitable for applications, or gage of a knitting machine to be used may be selected.

The elastic warp knitted fabric of the present invention is knitted using at least two guide bars, and is characterized in that elastic fibers are arranged on at least one guide bar and inelastic fibers are arranged on the other guide bar. As for a guide bar to be used in knitting, when viewed from the front side of a knitting machine, a guide bar at the most front side is represented as a front guide bar, a guide bar at the most back side is represented as a back guide bar, and a guide bar at the middle side thereof is represented as a middle guide bar. In the case of using two guide bars, which fiber should be used in which guide bar is not especially limited however, because arrangement of the elastic fibers at the front guide bar tends to make the elastic fibers appear at the surface, it may deteriorate surface quality, it is preferable that the inelastic fibers are arranged at the front guide bar, and the elastic fibers are arranged at the back guide bar. Also in the case of knitting using three guide bars, which fiber should be used in which guide bar is not especially limited, however, because of the above reason and because arrangement of the elastic fibers at each of the back guide bar and the middle guide bar increases total weight, thus giving heavy feeling in wearing, it is preferable that the elastic fibers are arranged only at the back guide bar.

It is preferable that in the elastic warp knitted fabric of the present invention, the elastic fibers are threaded through in full set, and the elastic fibers form a loop. In the case of not threaded through the elastic fibers in full set, extensibility of a part not containing the elastic fibers may decrease, whereas in the case where the elastic fibers do not configure a loop, it gives only such one as having high stress in extension, or makes a position of the elastic fibers in a knitted fabric unstable, which may lose shape in wearing as a garment or deteriorate surface quality.

The elastic warp knitted fabric of the present invention is characterized in that an extension force in a warp direction and that in a weft direction are 100 cN to 600 cN, in extension by 80%, and this ratio of the extension force in the warp direction/the weft direction is 0.8 to 1.8.

The extension force in a warp direction and that in a weft direction are preferably 100 cN to 500 cN, more preferably 100 cN to 300 cN, and still more preferably 100 cN to 200 cN. The extension force below 100 cN may deteriorate extension recovery characteristics, on the other hand, the extension force over 600 cN may give stiff feeling in motion, due to too high extension force. In addition, the extension force ratio is preferably 0.9 to 1.7, more preferably 0.9 to 1.6, and still more preferably 1.0 to 1.5. The ratio of the extension force in the warp direction/the weft direction below 0.8 or over 1.8 may cause to lose shape due to wearing as a garment or deteriorate or may deteriorate fit feeling.

It should be noted that "the ratio of the extension force in the warp direction/the weft direction, in extension of the knitted fabric by 80%" specified in the present invention shall be a value determined by the following formula (1):

$$\text{Ratio of the extension force}=(\text{extension force in the warp direction}/(\text{extension force in the weft direction}) \quad \text{Formula (1),}$$

wherein measurement value of out-bound stress in an extension rate of 80%, in tensile test of the elastic warp knitted fabric in a weft direction and a warp direction, is adopted as the extension force, as will be explained below.

The elastic warp knitted fabric of the present invention is characterized in that both of extension recovery percentage in the warp direction and that in the weft direction, after extension and recovery by 80% are repeated three times, are 85% or more. The extension recovery percentage in the warp direction and that in the weft direction, after extension and recovery by 80% are repeated three times, below 85% may cause to lose shape due to wearing as a garment.

The "extension recovery percentage in the warp direction and that in the weft direction, after extension and recovery by 80% are repeated three times" in the present description shall be a value determined by the following formula (2):

$$\text{Extension recovery percentage (\%)}=[(80-(\text{residual extension}))\div 80)]\times 100 \quad \text{Formula (2),}$$

by reading residual extension (%) after three times of repetition of extension and recovery, from an extension recovery curve obtained by measuring out-bound stress and in-bound stress in repeated extension recovery up to extension rate of 80%, in a tensile test of the elastic warp knitted fabric in the warp direction and in the weft direction, as will be explained below.

Losing of shape or fit feeling in practical wearing is largely influenced by extension recovery percentage of cloth to be used in a wear, however, in practical movement, it is important that cloth follows movement, and in order to attain this, instantaneous recovery characteristics is important. Accordingly, the present inventors have intensively studied on this and have created an index for evaluation of instantaneous recovery characteristics.

FIG. 1 shows a schematic drawing of a testing machine used in evaluation of instantaneous recovery characteristics. Using a De Mattia fatigue testing machine (a DC-3 model), manufactured by Daiei Kagaku Seiki MFG. Co., Ltd., a sample cut in 20 cm square was attached to a gripper 1*a* of a fixed sample of the testing machine, fixed it at a sample fixing frame 1*b* and set at the testing machine. Further, at a gripper of a movable sample 1*c* of the same testing machine, a push-up round bar 1*d* was installed. Height of the push-up round bar was adjusted, so as to attain the maximum push-up height of the push-up round bar 1*d* of 6 cm upward from the sample fixing frame 1*b*. The maximum push-up height of the push-up round bar was set so that the sample is extended about 50%, at the time of the maximum push-up.

A high speed camera, "Sunflower GE200", manufactured by Library Co., Ltd., was installed using a tripod, at a position horizontal to a sample fixing frame, and a position of 20 cm from the front face of the sample fixing frame. De Mattia fatigue testing machine was set so as to operate push-up action 500 times per minute, to start operation, and photographs of the push-up action at the 500 times were taken under a condition of 200 comas per second. Provided that time when the tip of the round bar passed through the lower end of the sample fixing frame in descending of the round bar after 500 times of push-up actions, was set as 0, maximum sample slack from the sample fixing frame within 0.05 second therefrom was measured from a moving image photographed, using motion analysis software "Move-tr/2D", manufactured by Library Co., Ltd.

The smaller sample slack in this time shows the more superior instantaneous recovery characteristics, and the better motion followability, and the maximum sample slack is preferably 3.0 mm or less, and particularly preferably 2.0 mm or less.

Superiority in the instantaneous recovery characteristics means no slack of the knitted fabric on extension, after bending of an elbow or a knee in wearing, and means small decrease in supporting force. It follows not only an elbow or a knee but also change in size of a muscle part accompanying with muscle shrinkage and muscle relaxation in motion, and is superior in effect of maintaining muscle in motion with always constant supporting force. Therefore, based on this finding, it has been clarified that in trial manufacturing of, for example, a long tights from the elastic warp knitted fabric of the present invention for performing bending and stretching motion of a knee, amount of oxidized hemoglobin in the rectus femoris muscle tissues showed higher result, as compared with a bare foot state not wearing the long tights, or a conventional long tights. Oxidized hemoglobin is hemoglobin which carried oxygen from a lung, and in particular, presence of oxidized hemoglobin in a large quantity in a muscle texture in aerobic exercise, means that a muscle, which obtains energy by decomposition of fat or sugar using oxygen, is in an energy-sustaining environment. This effect is considered to be brought about by promotion of venous return and enhancement of blood flow, owing to good instantaneous recovery characteristics of the elastic warp knitted fabric of the present invention.

To make this instantaneous recovery characteristics good, it is necessary that both of extension recovery percentage in the warp direction and that in the weft direction, after three times of repetition of extension and recovery by 80% of the knitted fabric, are 85% or more, and at the same time ratio of the extension force in the warp direction to that in the weft direction is 0.8 to 1.8, in extension by 80% of the knitted fabric.

To attain this, it is necessary to contrive texture configuration of the inelastic fibers which inhibit easy extension of the elastic fibers, and the present inventors have found that it is important to adjust inclination of a stitch of the inelastic fibers, in particular, a stitch configured by the elastic fibers and the inelastic fibers.

It is preferable that the elastic warp knitted fabric of the present invention contains a stitch of the inelastic fibers whose inclination is 20 to 70 degree, measured by a method to be described later, particularly preferably 20 to 60 degree, and still more preferably 30 to 50 degree.

The inclination of the stitch of the inelastic fibers below 20 degree results in large influence on extension of the stitch in a warp direction, decreases extensibility in a weft direction and thus may not provide predetermined level of ratio of the extension force in the warp direction/in the weft direction. The inclination of the stitch of the inelastic fibers over 70 degree deteriorates knitting characteristics and may make knitting difficult. It is preferable that ratio of the stitches having a stitch inclination of 20 to 70 degree, in total loops of the inelastic fibers in unit area in a knitted fabric, is preferably 20 to 80%, and more preferably 25 to 60%.

As for arrangement of the stitches having inclination, it is preferable to be present by each wale, and further, it is preferable that the stitches having inclination present within the same wale are present in a ratio of 50 to 100%.

The "inclination of the stitch of the inelastic fibers", specified in the present invention, means the one determined by measuring inclination of a loop of the inelastic fibers relative to a course direction, using a protractor, from a surface photograph of a needle loop plane, by a magnification of 100 times, taken in an extended state of the knitted fabric under a stress of about 22 N in both of a warp direction and a weft direction at the same time, using Digital Microscope VHX-500, manufactured by Keyence Corp.

In the present description, the axis in a course direction is shown by an approximated straight line from a line connecting the centers of the stitches of the same wale continued in a course direction. Inclination of a loop of the inelastic fibers shall mean an angle (an acute angle side shall be adopted) where a straight line connecting the root and the tip of said loop crosses the straight line showing the axis in the course direction.

Figure 2:
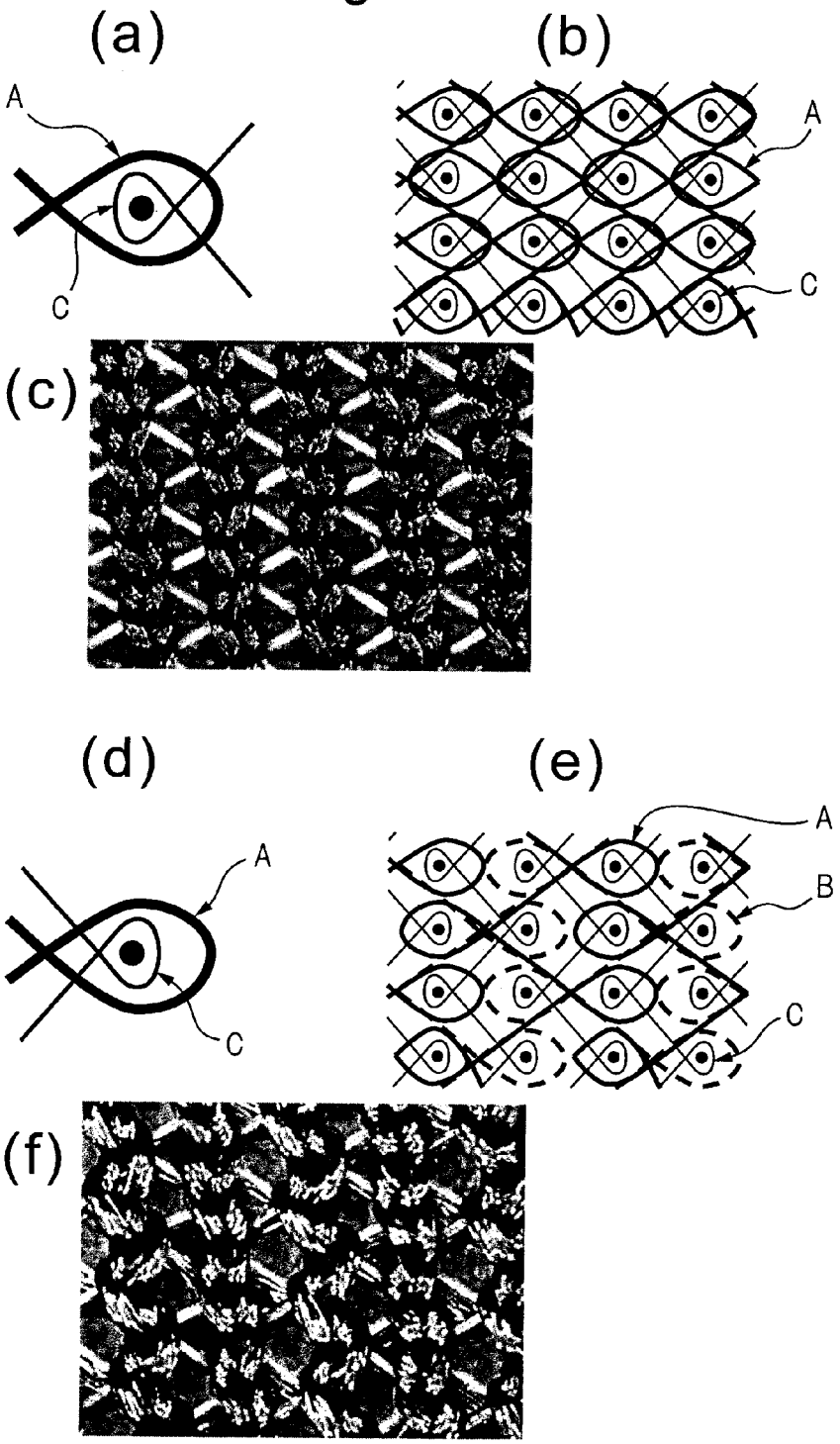
FIG. 2 is a yarn arrangement drawing of inelastic yarns and elastic yarns in stitches (aspects of (a), (b) and (c), along with aspects of (d), (e) and (f)).

The present inventors have found a method for changing inclination of the stitch of the inelastic fibers, by positional relation of the elastic fibers and the inelastic fibers configuring the stitch. Explanation will be given in detail, in FIG. 2, on a method for giving inclination to the stitch of the inelastic fibers.

A schematic drawing of a half tricot 2 way knitted texture is shown in FIG. 2*b*, and a magnified photograph of a knitted fabric surface is shown in FIG. 2*c*. Said half tricot knitted fabric is obtained by knitting a base texture with a knit texture of 1-0/2-3 using the inelastic fibers, and combining to this base texture a knit texture of 1-2/1-0 using the elastic fibers. This knitted fabric has the inelastic fibers and the elastic fibers in a different direction (2*a*), in all stitches, resulting in uniform force exerted on the stitches of the inelastic fibers and the elastic fibers, thus providing a configuration where stitches of the inelastic fibers on the knitted fabric align in parallel to the axis in a course direction. Inclination of the stitches of the inelastic fibers, practically measured from a photograph of FIG. 2*c* is all in a range of 0 to 15 degree.

Extension of the present knitted fabric in a warp direction provides such one that has large extensibility in a warp direction of the knitted fabric, because easily deformable stitches are continued in a course direction, that is, in a warp direction of the knitted fabric. On the other hand, in the weft direction of the knitted fabric, extensibility is determined only by extension easiness of a sinker loop connecting the stitches, and extension of the knitted fabric in a weft direction provides such one that has small extensibility in the weft direction of the knitted fabric, because the inelastic fibers having lower extensibility stiffen before the elastic fibers, and decreases ratio of the extension force in the warp direction/in the weft direction, in extension, below 0.8, and that makes inferior instantaneous recovery characteristics.

On the other hand, a schematic drawing of a knitted fabric texture, as one preferable aspect of the present invention, is shown in FIG. 2*e*, and a magnified photograph of a knitted fabric surface is shown in FIG. 2*f*. This corresponds to the one which is obtained by using three guide bars and a texture of the inelastic fibers of the middle guide bar is made in the same direction relative to the elastic fibers. In this knitted fabric, the inelastic fibers and the elastic fibers are in the same direction (2*d*), in a stitch formed by the inelastic fibers of the middle guide bar, resulting in a stitch of the inelastic fibers to be inclined in a well direction, by biasing force exerted on a stitch to one side. In inclination of stitches formed by the inelastic fibers of the middle guide bar, which is actually measured from a photograph of FIG. 2*f*, there are present many parts showing the inclination of a range of 20 to 70 degree.

This knitted fabric becomes easily extended not only in a warp direction but also in a weft direction, because of easy deformability of a stitch also by force in a weft direction of the knitted fabric. As a result, it provides a knitted fabric superior in extension force, ratio of extension force and instantaneous recovery characteristics.

A suitable knit texture for expressing performance of the present invention includes the following three textures, The first suitable knit texture is a texture, in the elastic warp knitted fabric knitted using three guide bars, the elastic fibers are threaded through on one guide bar, and the inelastic fibers are threaded through on the other two guide bars, in a positional relation to complement threaded through positions thereof each other, in 1-in, 1-out, respectively. In particular, it is preferable that the elastic fibers are the Denbigh texture, and further a texture of either of the guide bars where the inelastic fibers are threaded through is a plain cord texture with the same direction relative to the texture of the elastic fibers, and the other one is a plain cord texture with different direction relative to the texture of the elastic fibers.

A preferable texture where the elastic fibers are arranged and knitted is the Denbigh texture, and the Denbigh texture includes the closed-loop Denbigh texture shown by 1-2/1-0, the open-loop Denbigh texture shown by 2-1/0-1, or the like, and is not especially limited. Knitting a texture of the elastic fibers by other than the Denbigh texture provides only such one that has strong power, which limits applications, and is thus not preferable.

It is preferable, in a texture of the inelastic fibers, to thread the inelastic fibers in 1-in, 1-out, respectively, in a positional relationship mutually complementing a threaded position, to suppress thickness of cloth, and the closed-loop plain texture shown by 1-0/2-3, 2-3/1-0, and the open-loop plain texture shown by 0-1/3-2, 3-2/0-1 is preferable. In the present description, to thread in 1-in, 1-out shall mean to thread by each other stitch relative to a threaded position of a guide bar.

It is preferable that a texture of either of the guide bars where the inelastic fibers are threaded through is a plain cord texture with the same direction relative to the texture of the elastic fibers, and the other one is a plain cord texture with different, direction relative to the texture of the elastic fibers. In the case where all of the inelastic fibers are in a different direction from that of the elastic fiber such a configuration is given that stitches of the inelastic fibers on the knitted fabric all align in a course direction, which may deteriorate balance of extension force in a warp direction and a weft direction, and may deteriorate instantaneous recovery characteristics. In the case where all of the inelastic fibers are in the same direction as that of the elastic fiber, ail stitches of the inelastic fibers on the knitted fabric incline in a wale direction, providing little extension of the knitted fabric in a warp direction, which may deteriorate balance of extension force in a warp direction and a weft direction, and may deteriorate instantaneous recovery characteristics.

The second suitable knit texture is the one knitted at least one kind of the inelastic fibers course by course, by reciprocating in Atlas knitting over 5 wales by two needle swing. In particular, it is preferable that it is knitted using three guide bars, wherein the elastic fibers are knitted course by course, by reciprocating in Atlas knitting over 3 wales by one needle swing, and at least one kind of the inelastic fibers is knitted course by course, by reciprocating in Atlas knitting over 5 wales by two needle swing. In this case, it is preferable that Atlas knitting of the inelastic fibers is in an opposite direction from that of the elastic fibers. Knitting of the elastic fibers course by course, by reciprocating in Atlas knitting over 4 wales by one needle swing makes difficult to take balance of the inelastic fibers and the elastic fibers, may raise a problem of knitting characteristics. In addition, knitting of the elastic fibers in two or more needle swings increases the overlap of sinker loop, resulting in increase in thickness of a knitted fabric.

Knitting of at least one kind of the inelastic fibers course by course, by reciprocating in Atlas knitting over 5 wales by one needle swing, provides little allowance of the sinker loop of the inelastic fibers, which may not show sufficient extension as cloth. In addition, knitting of at least one kind of the inelastic fibers course by course, by reciprocating in Atlas knitting over 3 wales by one needle swing, decreases the extension easiness, in particular, in a warp direction, as well as decreases the recovery characteristics, which may deteriorate fit feeling in wearing as a product.

Knitting of at least one kind of the inelastic fibers course by course, by reciprocating in Atlas knitting over 6 wales by two needle swing in an opposite direction from the elastic fibers, provides a strong texture pattern, thus may give a unique appearance.

Knitting of at least one kind of the inelastic fibers course by course, by reciprocating in Atlas knitting over 5 wales by two needle swing in the same direction as the elastic fibers, provides stitches of the inelastic fibers on the knitted fabric all inclined in a wale direction, little extension of the knitted fabric in a warp direction, which may deteriorate balance of extension force in a warp direction and a weft direction, and may deteriorate instantaneous recovery characteristics In knitting using three guide bars in the elastic warp knitted fabric of the present invention, it is preferable that the inelastic fibers are threaded in the front and the middle guide bars. In this case, knitting of the inelastic fibers arranged at any of the guide bars, course by course, by reciprocating in Atlas knitting over 5 wales by two needle swing in an opposite direction from the elastic fibers, and knitting of the inelastic fibers arranged at other reeds guide bars, by reciprocating in Atlas knitting over 5 wales by two needle swing in the same direction as the elastic fibers, are particularly preferable, in view of easy expression of extensibility in both of warp and weft directions.

The third suitable one is, in each of the above two kinds of the knit textures, a knit texture of the elastic warp knitted fabric of the present invention, where a knitted texture of the elastic fibers is a two needle stitch. Adoption of the two needle stitch may not provide such one that has low extension stress, however, is effective to obtain such one that has high extension stress. However, excessively high extension stress may give stiff feeling in motion and could inhibit motion, thus it is similarly not preferable to make an inserted texture of the elastic fibers providing large extension force, or make a knitted fabric texture by combined use of an insert texture.

In the two needle stitch of the elastic fibers of the elastic warp knitted fabric of the present invention, a texture of the two needle stitch may be knitted only in the same wale, or may be knitted by straddling different wales in a course direction, however, a zigzag-like knit texture in a course direction is preferable, including, for example, a texture 2-0/1-3, 0-2/3-1, 2-0/1-3/3-5/4-2, or the like. The two needle stitch not knitting in zigzag way in a course direction increases overlap of the elastic fibers, and provides only such one that has relatively large extension stress, or increases thickness of the knitted fabric, and is thus not preferable. For example, a suitable texture includes 2-0/2-0, 2-0/0-2 or the like.

Specifically, in the first suitable knit texture, that is, in a warp knitted fabric knitted by three guide bars, such a texture is preferable that the elastic fibers harness threaded on one guide bar are a two needle stitched texture and knitted in a zigzag way in a course direction, and the inelastic fibers are threaded on the other guide bars, in a positional relation so as to complement threaded position thereof each other, in 1-in, 1-out, respectively. Such a texture is particularly preferable that either of the textures of reeds guide bars, where the inelastic fibers are threaded through, is a plain cord texture in the same direction relative to the texture of the elastic fibers knitted in a zigzag way in a course direction, and the other texture is a plain cord texture in a different direction relative to the texture of the elastic fibers.

In addition, in the second suitable knit texture, that is, in a warp knitted fabric knitted by three guide bars, it is preferable that the elastic fibers are knitted in a two needle stitched texture, in a zigzag way in a course direction; at least one kind of the inelastic fibers is knitted course by course, by reciprocating in Atlas knitting over 5 wales by two needle swing; and other one kind of the inelastic fibers is knitted course by course, by reciprocating in Atlas knitting over 5 wales by two needle swing in a different direction from the inelastic fibers.

Explanation will be given below on preferable aspects and production conditions common to the elastic warp knitted fabric of the present invention.

In the elastic warp knitted fabric of the present invention, in the case of knitting using three guide bars, the inelastic fibers may be threaded in the front guide bar or the middle guide bar in full set, however, to suppress thickness of cloth, it is preferable that the inelastic fibers are threaded, in a positional relation so as to complement threaded positions thereof each other, in 1-in, 1-out, respectively. In the present description, threading of 1-in, 1-out shah mean to thread once every needle relative to the threaded position of a guide bar.

As knitting condition of a gray fabric, it is enough to adjust runner length as appropriate by combining the above yarn usage, yarn denier and a texture so as to attain stable tension and superior cloth quality. It should be noted that "runner" means yarn length (cm) to be used in knitting certain course number (this is called "rack", and usually 480 courses are set as one rack).

The elastic warp knitted fabric of the present invention may be knitted using a tricot knitting machine or the Russell knitting machine, and gauge of the knitting machine is not especially limited, however, it is preferable to select arbitrary a knitting machine of 18 to 40 gauge, depending on applications or size of yarn to be used.

In the elastic warp knitted fabric of the present invention, it is preferable that total weight is adjusted in accordance with applications required, and more preferably, total weight is adjusted in a range of 100 to 500 ($g/m^2$).

In the elastic warp knitted fabric of the present invention, it is preferable that thickness is adjusted in accordance with applications required, and more preferably, thickness is adjusted in a range of 0.4 to 1.0 (mm).

The elastic warp knitted fabric of the present invention is subjected to finishing of scouring, heat set, dyeing, or the like, after obtaining a gray fabric knitted fabric. These finishing may be performed in accordance with a finishing method for a usual elastic fibers mixture warp knitted fabric. In addition, finished density is preferably adjusted as appropriate depending on extensibility and extension balance required, and it is more preferable that finished density is adjusted in a range of 50 to 100 wells, 80 to 150 courses, per 1 inch (2.54 cm).

Further, as additional finishing at a dyeing stage, soil release finish, antibacterial treatment, deodorant finish, anti-odor finishing, sweat absorption finish, moisture absorption finish, UV absorption finish, alkali treatment, or the like, and as after processing, calendering, embossing, wrinkle process, raising process, opal finish, softening finish using a silicone-based softening agent or the like may be furnished as appropriate depending on characteristics finally required.

The elastic warp knitted fabric of the present invention can be utilized to, for example, an innerwear, a sportswear, and a swimsuit or the like which fit to a body, and use of the elastic warp knitted fabric of the present invention enables to provide good wearing feeling, and excellent motion followability, and thereby contributing to enhancement in movement function, and still more enables to produce a garment having no limitation in applications due to extension force thereof, less likely to lose shape due to wearing, and superior in wearing feeling and appearance.

EXAMPLES

Concrete Explanation will be given below on the present invention with reference to Examples.

Each evaluation in Examples was performed as follows.

(1) Inclination of the Inelastic Fibers in a Well Direction

A surface photograph of a needle loop plane, by a magnification of 100 times, is taken in an extended state of the knitted fabric under a stress of about 22 N in both of a warp direction and a weft direction at the same time, using Digital Microscope VHX-500, manufactured by Keyence Corp. Inclination of a loop of the inelastic fibers relative to a course direction is measured, using a protractor, from the photograph taken.

The axis in a course direction: It is shown by an approximated straight line from the centers of the stitches of continued in a course direction.

Inclination of a loop of the inelastic fibers: It is shown by an angle (an acute angle side shall be adopted) where a straight line connecting the root and the tip of one loop crosses the straight line showing the axis in the above course direction at the vicinity of the center of the loop.

(2) Extension Force and Ratio of Extension Force

A knitted fabric with a width of 2.5 cm, held in a holding space of 10 cm, was subjected to three times of repetition of extension and recovery in a tension speed of 300 mm/minute, using a tensile testing machine, to measure out-bound stress up to extension rate of 80%, and in-bound stress, and draw an extension recovery curve, and stress at the extension rate of 80% in the first extension was adopted as extension force. Ratio of extension force was determined according to the following formula (1):

$$\text{Ratio of the extension force}=(\text{extension force in the warp direction}/(\text{extension force in the weft direction}) \quad \text{Formula (1),}$$

by reading each extension force from the extension recovery curve in a warp direction and a weft direction.

(3) Extension Recovery Percentage

Extension recovery percentage was determined according to the following formula (2):

$$\text{Extension recovery percentage (\%)}=[(80-(\text{residual extension}))\div 80)]\times 100 \quad \text{Formula (2),}$$

by reading residual extension (%) from the extension recovery curve obtained by the testing method for ratio of the extension force.

(4) Cloth Slack

Using a De Mattia fatigue testing machine (a DC-3 model), manufactured by Daiei Kagaku Seiki MFG. Co., Ltd., shown in FIG. 1, a sample cut in 20 cm square was attached to a gripper 1*a* of a fixed sample of the testing machine, fixed it at a sample fixing frame 1*b* and set at the testing machine. Further, at a gripper of a movable sample 1*c* of the same testing machine, a push-up round bar 1*d* was installed. Height of the push-up round bar was adjusted, so as to attain the maximum push-up height of the push-up round bar 1*d* of 6 cm upward from the sample fixing frame 1*b*. The maximum push-up height of the push-up round bar was set so that the sample is extended about 50%, at the time of the maximum push-up.

Next, a high speed camera, "Sunflower GE200", manufactured by Library Co., Ltd., was installed using a tripod, at a position horizontal to a sample fixing frame, and a position of 20 cm from the front face of the sample fixing frame.

De Mattia fatigue testing machine was set so as to operate push-up action 500 times per minute, to start operation, and photographs of the push-up action at the 500 times were taken under a condition of 200 comas per second.

Provided that time when the tip of the round bar passed through the lower end of the sample fixing frame in descending of the round bar, after 500 times of push-up actions, was set as 0, maximum sample slack from the sample fixing frame within 0.05 second therefrom was measured from a moving image photographed, using motion analysis software "Movetr/2D", manufactured by Library Co., Ltd.

(5) Shape Losing Characteristics Due to Wearing

A tennis shirt fitted to a body was sewn using the elastic warp knitted fabric prepared in Example 1, which was undressed after two hours of tennis playing, to observe presence or absence of shape loss (deformation) of the knitted fabric, in particular, at an elbow portion, as well as to assess by visual inspection, as for a shirt whose knitted fabric was deformed at the elbow portion, based on the following evaluation criteria, taking into consideration of whether the deformation is eliminated or not by crumpling with hands after undressed. The following rank 3 or higher can be said a level with practically no problems.

5: Completely no shape loss.

4: Certain shape loss is observed at the elbow portion, however, in a degree of not being concerned about.

3: The elbow portion is deformed, however, it is eliminated by crumpling.

2: The elbow portion is deformed largely, which does not return to an original shape unless by considerable crumpling.

1: The elbow portion is deformed seriously, which does not return to an original shape even by considerable crumpling.

Example 1

Figure 3:
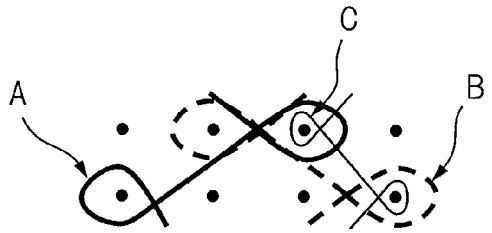
FIG. 3 is one example of a texture drawing of an elastic warp knitted fabric of the present invention (Example 1).

A gray fabric was obtained using a 28 gauge single tricot machine, manufactured by Karl Mayer Co., Ltd., by arranging polyester filaments of 34 dtx-18f at a front and middle reeds, and polyurethane fibers of 33 dtx at a back reed, and arranging a front texture in 3-4/2-1 and 1-in, 1-out, and arranging said runner in 140 (cm/rack), a middle texture in 1-0/2-3 and one-in, one-out, and knitting said runner in 140 (cm/rack), a back texture in 1-0/1-2 and said runner in 89 (cm/rack). FIG. 3 shows a drawing of this texture.

This gray fabric was finished in usual dyeing and water absorbing softening finish steps of an elastic warp knitted fabric to obtain a knitted fabric. That is, the knitted fabric, having total weight and density as shown in the following Table 1, was obtained by performing relaxing and scouring using three tanks in total, a tank of 50° C., a tank of 60° C., and a tank of 80° C., and performing heat set at 190° C., still more performing finishing set at 170° C. with combined use of a commercial water absorbing agent for polyester, after dyeing at 130° C. and furnishing a commercial softening agent.

Assessment results of the obtained knitted fabric are shown in Table 1. The obtained knitted fabric was superior in extension balance in a warp direction and a weft direction, and extension recovery percentage, and was a knitted fabric providing good fit feeling and small shape loss due to wearing.

Example 2

A knitted fabric, having total weight and density as shown in the following Table 1, was obtained under the same condition as in Example 1, except that a front texture was knitted in 1-0/2-3, said runner in 154 (cm/rack), a middle texture in 3-4/2-1, said runner in 150 (cm/rack), and a back runner in 86 (cm/rack).

Assessment results of the obtained knitted fabric are shown in Table 1. The obtained knitted fabric was superior in extension balance in a warp direction and a weft direction, and extension recovery percentage, and was a knitted fabric with small shape loss due to wearing.

Example 3

A knitted fabric, having total weight and density as shown in the following Table 1, was obtained under the same condition as in Example 1, except that a front runner was knitted in 146 (cm/rack), a middle texture in 3-2/0-1, said runner in 146 (cm/rack), and a back runner in 85 (cm/rack).

Assessment results of the obtained knitted fabric are shown in Table 1. The obtained knitted fabric was superior in extension balance in a warp direction and a weft direction, and extension recovery percentage, and was a knitted fabric with small shape loss due to wearing.

Example 4

A knitted fabric, having total weight and density as shown in the following Table 1, was obtained under the same condition as in Example 1, except that nylon filaments of 44 dtx-34f were arranged at the front and the middle reeds.

Assessment results of the obtained knitted fabric are shown in Table 1. The obtained knitted fabric was superior in extension recovery percentage, and was a knitted fabric with small shape loss due to wearing, although showed a little inferior extension balance in a warp direction and a weft direction.

Example 5

Figure 4:
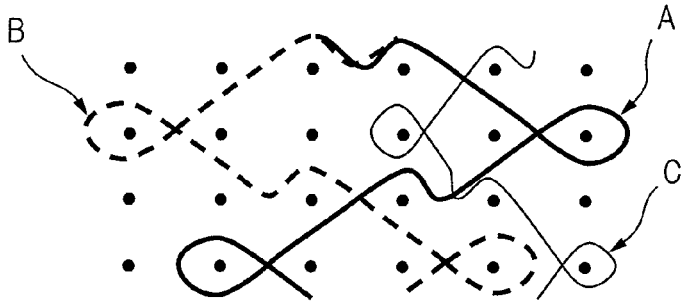
FIG. 4 is one example of a texture drawing of an elastic warp knitted fabric of the present invention (Example 5).

A gray fabric was obtained using a 28 gauge single tricot machine, manufactured by Karl Mayer Co., Ltd., by harness coding polyester filaments of 44 dtx/24f at the front and middle reeds, each 1-in, 1-out, and polyurethane fibers of 22 dtx at the back reed in full set, to knit a front texture in 4-5/3-2/1-0/2-3, said runner in 154 (cm/rack), a middle texture in 2-1/3-4/5-6/4-3, said runner in 150 (cm/rack), and a back texture in 1-0/1-2/2-3/2-1 and said runner in 86 (cm/rack). FIG. 4 shows a drawing of this texture. This gray fabric was dyeing finished similarly as in Example 1 to obtain a knitted fabric, having total weight and density as shown in the following Table 4.

Assessment results of the obtained knitted fabric are shown in Table 1. The obtained knitted fabric was superior in extension balance in a warp direction and a weft direction, and extension recovery percentage, and was a knitted fabric providing good fit feeling and small shape loss due to wearing.

Example 6

Figure 5:
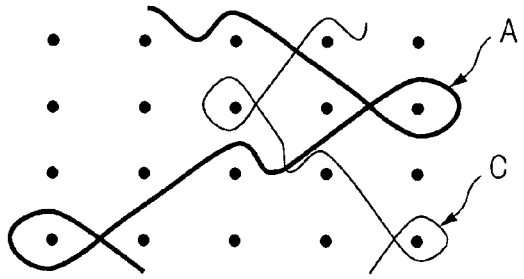
FIG. 5 is one example of a texture drawing of an elastic warp knitted fabric of the present invention (Example 6).

A gray fabric was obtained using a 32 gauge single tricot machine, manufactured by Karl Mayer Co., Ltd., by threading polyester filaments of 33 dtx/48f at the front guide bar, and polyurethane fibers of 22 dtx at the back guide bar, each in full set, to knit a front texture in 4-5/3-2/1-0/2-3, said runner in 140 (cm/rack), and a back texture in 1-0/1-2/2-3/2-1 and said runner in 70 (cm/rack). FIG. 5 shows a drawing of this texture. This gray fabric was dyeing finished similarly as in Example 1 to obtain a knitted fabric, having total weight and density as shown in the following Table 1.

Assessment results of the obtained knitted fabric are shown in Table 1. The obtained knitted fabric was superior in extension balance in a warp direction and a weft direction, and extension recovery characteristics, and was a knitted fabric providing good fit feeling and small shape loss due to wearing.

Example 7

A knitted fabric, having total weight and density as shown in the following Table 1, was obtained under the same condition as in Example 5, except by threading polyester filaments of 44 dtx at the front and the middle guide bars, and polyurethane fibers of 44 dtx at the back guide bar, a front runner in 152 (cm/rack), a middle runner in 146 (cm/rack), and a back runner in 85 (cm/rack), Assessment results of the obtained knitted fabric are shown in Table 1. The obtained knitted fabric was superior in extension balance in a warp direction and a weft direction, and extension recovery characteristics, and was a knitted fabric providing good fit feeling and small shape loss due to wearing.

Example 8

Figure 6:
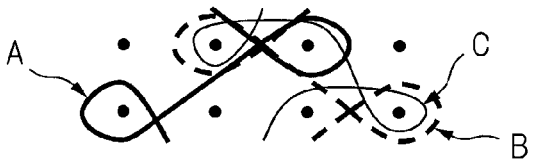
FIG. 6 is one example of a texture drawing of an elastic warp knitted fabric of the present invention (Example 8).

A gray fabric was obtained using a 28 gauge single tricot machine, manufactured by Karl Mayer Co., Ltd., by arranging polyester filaments of 56 dtx/36f at the front and middle guide bars, and polyurethane fibers of 44 dtx at the back guide bar, a front texture in 3-4/2-1 and 1-in, 1-out, said runner in 165 (cm/rack), a middle texture in 1-0/2-3, and 1-in, 1-out, said runner in 160 (cm/rack), and a back texture in 2-0/1-3 and said runner in 190 (cm/rack). FIG. 6 shows a drawing of this texture. This gray fabric was dyeing finished similarly as in Example 1 to obtain a knitted fabric, having total weight and density as shown in the following Table 1.

Assessment results of the obtained knitted fabric are shown in Table 1. The obtained knitted fabric was superior in extension balance in a warp direction and a weft direction, and extension recovery characteristics, and was a knitted fabric providing good fit feeling and small shape loss due to wearing.

Example 9

Figure 7:
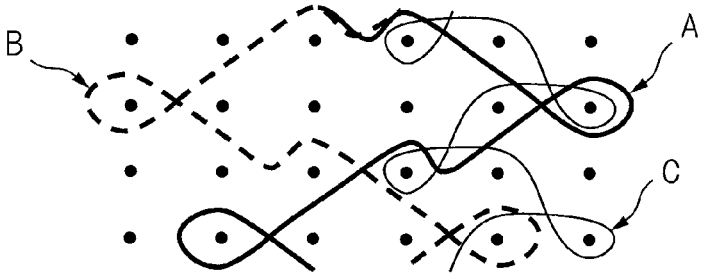
FIG. 7 is one example of a texture drawing of an elastic warp knitted fabric of the present invention (Example 9).

A gray fabric was knitted under the same condition as in Example 8, except that by knitting a front texture in 4-5/3-2/1-0/2-3, said runner in 175 (cm/rack), and a middle texture in 2-1/3-4/5-6/4-3, said runner in 175 (cm/rack). FIG. 7 shows a drawing of this texture. This gray fabric was dyeing finished similarly as in Example 1 to obtain a knitted fabric, having total weight and density as shown in the following Table 1.

Assessment results of the obtained knitted fabric are shown in Table 1. The obtained knitted fabric was superior in extension balance in a warp direction and a weft direction, and extension recovery characteristics, and was a knitted fabric providing good fit feeling and small shape loss due to wearing.

Comparative Example 1

Figure 8:
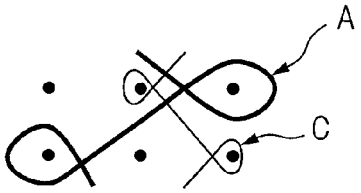
FIG. 8 is one example of a texture drawing of a conventional knitted fabric (Comparative Example 1).

A gray fabric was obtained using a 28 gauge single tricot machine, manufactured by Karl Mayer Co., Ltd by threading polyester filaments of 34 dtx-18f at a front guide bar, and polyurethane fibers of 33 dtx at a back guide bar, each in full set, to knit a front texture in 2-3/1-0, said runner in 140 (cm/rack), and a back texture in 1-0/1-2, said runner in 89 (cm/rack). FIG. 8 shows a drawing of this texture. This gray fabric was dyeing finished similarly as in Example 1 to obtain a knitted fabric, having total weight and density as shown in the following Table 1.

Assessment results of the obtained knitted fabric are shown in Table 1. The obtained knitted fabric was inferior in extension balance in a warp direction and a weft direction, and was a knitted fabric providing inferior fit feeling and large shape loss due to wearing.

Comparative Example 2

Figure 9:
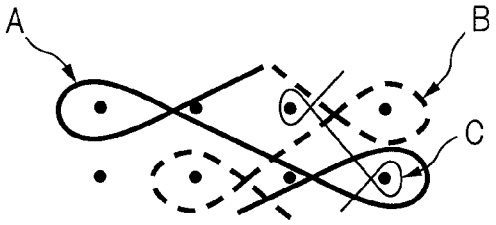
FIG. 9 is one example of a texture drawing of a conventional knitted fabric (Comparative Example 2).

A gray fabric was obtained by threading polyester filaments of 34 dtx/18f at the front and middle Feeds guide bars, and polyurethane fibers of 33 dtx at the back guide bar, each in full set, to knit a front texture in 1-0/4-5, said runner in 200 (cm/rack), a middle texture in 2-3/1-0, said runner in 140 (cm/rack), and a back texture in 1-0/1-2 and said runner in 89 (cm/rack). FIG. 9 shows a drawing of this texture. This gray fabric was dyeing finished similarly as in Example 1 to obtain a knitted fabric, having total weight and density as shown in the following Table 1.

Assessment results of the obtained knitted fabric are shown in Table 1. The obtained knitted fabric was inferior in extension balance in a warp direction and a weft direction, and was a knitted fabric providing inferior fit feeling and large shape loss due to wearing.

Comparative Example 3

Figure 10:
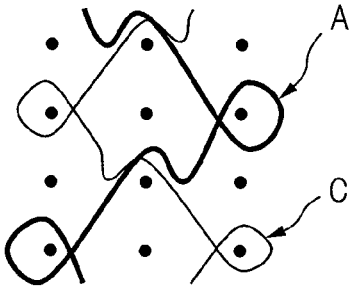
FIG. 10 is one example of a texture drawing of a conventional knitted fabric (Comparative Example 3).

A gray fabric was obtained using a 32 gauge single tricot machine, manufactured by Kari Mayer Co., Ltd., by threading nylon filaments of 33 dtx/10f at a front guide bar, and polyurethane fibers of 22 dtx at a back guide bar, each in full set, to knit a front texture in 2-3/2-1/1-0/1-2, said runner in 110 (cm/rack), and a back texture in 1-0/1-2/2-3/2-1, said runner in 70 (cm/rack). FIG. 10 shows a drawing of this texture. This gray fabric was dyeing finished similarly as in Example 1 to obtain a knitted fabric, having total weight and density as shown in the following Table 1, Assessment results of the obtained knitted fabric are shown in Table 1. The obtained knitted fabric was inferior in extension balance in a warp direction and a weft direction, and was a knitted fabric providing inferior fit feeling and large shape loss due to wearing.

Comparative Example 4

Figure 11:
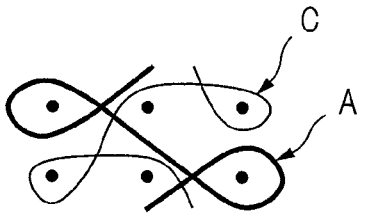
FIG. 11 is one example of a texture drawing of a conventional knitted fabric (Comparative Example 4).

A gray fabric was obtained using a 28 gauge single tricot machine, manufactured by Karl Mayer Co., Ltd., by threading polyester filaments of 56 dtx/36f at a front guide bar, and polyurethane fibers of 44 dtx at a back guide bar, each in full set, to knit a front texture in 1-0/2-3, said runner in 165 (cm/rack), and a back texture in 1-3/2-0, said runner in 190 (cm/rack). FIG. 11 shows a drawing of this texture. This gray fabric was dyeing finished similarly as in Example 1 to obtain a knitted fabric, having total weight and density as shown in the following Table 1.

Assessment results of the obtained knitted fabric are shown in Table 1. The obtained knitted fabric was inferior in extension balance in a warp direction and a weft direction, and was a knitted fabric providing inferior fit feeling and large shape loss due to wearing.

TABLE 1

| Gauge | | Example 1 28GG | Example 2 28GG | Example 3 28GG | Example 4 28GG | Example 5 28GG | Example 6 32GG | Example 7 28GG |
|---|---|---|---|---|---|---|---|---|
| Front reed | Fiber kind | Polyester | Polyester | Polyester | Nylon | Polyester | Polyester | Polyester |
| | Fineness/ f-Number | 34dtex/18f | 34dtex/18f | 34dtex/18f | 44dtex/34f | 44dtex/24 | 33dtex/48f | 44dtex/36 |
| | Runner length (cm/rack) | 140 | 154 | 152 | 140 | 154 | 140 | 152 |
| | Weave | 3-4/2-1 | 1-0/2-3 | 3-4/2-1 | 2-3/1-0 | 4-5/3-2/ 1-0/2-3 | 4-5/3-2/ 1-0/2-3 | 4-5/3-2/ 1-0/2-3 |
| | Fiber supply | 1-in, 1-out | 1-in, 1-out | 1-in, 1-out | 1-in, 1-out | 1-in, 1-out | Full set | 1-in, 1-out |
| Middle reed | Fiber kind | Polyester | Polyester | Polyester | Nylon | Polyester | — | Polyester |
| | Fineness/ f-Number | 34dtex/18f | 34dtex/18f | 34dtex/18f | 44dtex/34f | 44dtex/24 | | 44dtex/36 |
| | Runner length (cm/rack) | 140 | 150 | 146 | 140 | 150 | | 146 |
| | Weave | 1-0/2-3 | 3-4/2-1 | 3-2/0-1 | 1-0/2-3 | 2-1/3-4/ 5-6/4-3 | | 2-1/3-4/ 5-6/4-3 |
| | Fiber supply | 1-in, 1-out | 1-in, 1-out | 1-in, 1-out | 1-in, 1-out | 1-in, 1-out | | 1-in, 1-out |
| Back reed | Fiber kind | Polyurethane | Polyurethane | Polyurethane | Polyurethane | Polyurethane | Polyurethane | Polyurethane |
| | Fineness/ f-Number | 33dtex | 33dtex | 33dtex | 33dtex | 22dtex | 22dtex | 44dtex |
| | Runner length (cm/rack) | 89 | 86 | 85 | 89 | 86 | 70 | 85 |
| | Weave | 1-0/1-2 | 1-0/1-2 | 1-0/1-2 | 1-0/1-2 | 1-0/1-2/ 2-3/2-1 | 1-0/1-2/ 2-3/2-1 | 1-0/1-2/ 2-3/2-1 |
| | Fiber supply | Full set | Full set | Full set | Full set | Full set | Full set | Full set |
| Total weight (g/cm2) | | 163 | 161 | 172 | 188 | 261 | 332 | 308 |
| Thickness (mm) | | 0.66 | 0.70 | 0.72 | 0.58 | 0.81 | 0.87 | 0.83 |
| Course Number (course/in) | | 120 | 120 | 121 | 118 | 105 | 192 | 116 |
| Wale Number (wale/in) | | 73 | 73 | 74 | 71 | 67 | 92 | 72 |
| Inclination of nonelastic fibers in a wale direcrtion (degree) | | 36 | 33 | 30 | 39 | 53 | 51 | 40 |
| extension force (cN) | warp direction | 145 | 157 | 135 | 240 | 356 | 221 | 318 |
| | weft direction | 122 | 116 | 119 | 132 | 335 | 196 | 291 |
| Ratio of extension force | | 1.19 | 1.35 | 1.13 | 1.82 | 1.06 | 1.13 | 1.09 |
| extension recovery % | warp direction | 96.9 | 93.5 | 94.7 | 92.3 | 86.0 | 89.0 | 87.0 |
| | weft direction | 92.3 | 91.5 | 90.8 | 90.1 | 94.0 | 93.0 | 94.0 |
| Cloth slack (mm) | | 1.8 | 2.0 | 1.5 | 2.5 | 1.9 | 1.6 | 1.6 |
| Shape loss due to wearing | | 5 | 4 | 5 | 3 | 5 | 5 | 5 |

| Gauge | | Example 8 28GG | Example 9 28GG | Comparable Example 1 28GG | Comparable Example 2 28GG | Comparable Example 3 32GG | Comparable Example 4 28GG |
|---|---|---|---|---|---|---|---|
| Front reed | Fiber kind | Polyester | Polyester | Polyester | Polyester | Nylon | Polyester |
| | Fineness/ f-Number | 56dtex/36 | 56dtex/36 | 34dtx/18f | 34dtx/18f | 33dtex/10f | 56dtex/36 |
| | Runner length (cm/rack) | 165 | 175 | 140 | 200 | 110 | 165 |
| | Weave | 3-4/2-1 | 4-5/3-2/ 1-0/2-3 | 2-3/1-0 | 1-0/4-5 | 2-3/2-1/ 1-0/1-2 | 1-0/2-3 |
| | Fiber supply | 1-in, 1-out | 1-in, 1-out | Full set | Full set | Full set | Full set |
| Middle reed | Fiber kind | Polyester | Polyester | — | Polyester | — | — |
| | Fineness/ f-Number | 56dtex/36 | 56dtex/36 | | 34dtx/18f | | |
| | Runner | 160 | 175 | | 140 | | |

TABLE 1-continued

| | | | | | | | |
|---|---|---|---|---|---|---|---|
| | length (cm/rack) | | | | | | |
| | Weave | 1-0/2-3 | 2-1/3-4/ 5-6/4-3 | | 2-3/1-0 | | |
| | Fiber supply | 1-in, 1-out | 1-in, 1-out | | Full set | | |
| Back reed | Fiber kind | Polyurethane | Polyurethane | Polyurethane | Polyurethane | Polyurethane | Polyurethane |
| | Fineness/ f-Number | 44dtex | 44dtex | 33dtx | 33dtx | 22dtex | 44dtex |
| | Runner length (cm/rack) | 190 | 190 | 89 | 89 | 70 | 190 |
| | Weave | 2-0/1-3 | 2-0/1-3 | 1-0/1-2 | 1-0/1-2 | 1-0/1-2/ 2-3/2-1 | 1-3/2-0 |
| | Fiber supply | Full set | Full set | Full set | Full set | Full set | Full set |
| Total weight (g/cm2) | | 256 | 286 | 166 | 281 | 167 | 269 |
| Thickness (mm) | | 0.83 | 0.95 | 0.68 | 1.14 | 0.54 | 0.85 |
| Course Number (course/in) | | 108 | 111 | 121 | 129 | 142 | 106 |
| Wale Number (wale/in) | | 61 | 65 | 72 | 63 | 89 | 62 |
| Inclination of nonelastic fibers in a wale direcrtion (degree) | | 36 | 44 | 8 | 33 | 16 | 11 |
| extension force (cN) | warp direction | 472 | 582 | 117 | 254 | 338 | 539 |
| | weft direction | 371 | 394 | 191 | 427 | 135 | 283 |
| Ratio of extension force | | 1.27 | 1.48 | 0.61 | 0.59 | 2.50 | 1.90 |
| extension recovery % | warp direction | 92.0 | 89.2 | 93.0 | 89.7 | 86.8 | 92.0 |
| | weft direction | 95.5 | 92.3 | 88.8 | 83.5 | 87.7 | 95.9 |
| Cloth slack (mm) | | 1.7 | 1.9 | 9.5 | 7.6 | 4.3 | 3.9 |
| Shape loss due to wearing | | 5 | 5 | 1 | 1 | 2 | 3 |

INDUSTRIAL APPLICABILITY

Use of the elastic warp knitted fabric of the present invention, for example, in an innerwear, a sportswear, a swimsuit fit to a body or the like enables to provide good wearing feeling, and excellent motion followability, and thereby contributing to improvement in movement function, and still more enables to produce a garment having no limitation in applications due to extension force thereof, less likely to lose shape due to wearing, and superior in wearing feeling and appearance.

LEGENDS

1*a*: Sample gripper
1*b*: Sample fixing frame
1*c*: Gripper of a movable sample
1*d*: Push-up round bar
A: Inelastic fibers arranged at a front guide bar
B: Inelastic fibers arranged at a middle guide bar
C: Inelastic fibers arranged at a back guide bar

The invention claimed is:

1. An elastic warp knitted fabric having two or more guide bar fabric structure, characterized in that the elastic fibers are arranged on only one guide bar and inelastic fibers are arranged on the remaining guide bars, respectively, both an extension force in the warp direction and that in the weft direction are 100 cN to 600 cN, in extension by 80% of the said knitted fabric, and that the ratio of the extension force in the warp direction to that in the weft direction is 0.8 to 1.8, and also that both extension recovery percentage in the warp direction and that in the weft direction, after extension and recovery by 80% are repeated three times, are 85% or more.

2. The elastic warp knitted fabric according to claim 1, wherein the elastic fibers are threaded through a guide bar in full-set to form a loop.

3. The elastic warp knitted fabric according to claim 2, wherein inclination of a stitch of the inelastic fibers is 20 to 70 degrees.

4. The elastic warp knitted fabric according to any one of claims 1 to 3, wherein the elastic warp knitted fabric is knitted using three guide bars, elastic fibers are threaded through one guide bar, and inelastic fibers threaded through the other two guide bars, in a positional relation to complement threaded positions thereof each other, in 1-in, 1-out, respectively.

5. The elastic warp knitted fabric according to claim 4, wherein a texture of a guide bar where the elastic fibers are threaded through is the Denbigh texture, and a texture of either of the guide bars where the inelastic fibers are threaded through is a plain cord texture with the same direction relative to the texture of the guide bar where the elastic fibers are threaded through, and a texture of other guide bars is a plain cord texture with different direction relative to the texture of the guide bar where the elastic fibers are threaded through.

6. The elastic warp knitted fabric according to claim 4, wherein a texture of a guide bar where the elastic fibers are threaded through is a two needle stitched texture knitted in a zigzag way in a course direction, a texture of either of the guide bars where the inelastic fibers are threaded through is a plain cord texture with the same direction relative to the texture of the guide bar where the elastic fibers are threaded through, and a texture of other guide bars is a plain cord texture with different direction relative to the texture of the guide bar where the elastic fibers are threaded through.

7. The elastic warp knitted fabric according to any one of claims 1 to 3, wherein at least one kind of the inelastic fibers is knitted course by course, by reciprocating in Atlas knitting over 5 wales by two needle swing.

8. The elastic warp knitted fabric according to claim 7, wherein the elastic warp knitted fabric is knitted using three guide bars, the elastic fibers in one guide bar are knitted course by course, by reciprocating in Atlas knitting over 3 wales by one needle swing, the inelastic fibers in a second guide bar are knitted course by course, by reciprocating in Atlas knitting over 5 wales by two needle swing, in the same direction as the elastic fibers, and the inelastic fibers in a third guide bar are knitted course by course, by reciprocating in Atlas knitting over 5 wales by two needle swing in a different direction from the inelastic fibers.

9. The elastic warp knitted fabric according to claim 7, wherein the elastic warp knitted fabric is knitted using three guide bars, the elastic fibers in one guide bar are knitted by two needle stitched texture in a zigzag way in a course direction, the inelastic fibers in a second guide bar are knitted course by course, by reciprocating in Atlas knitting over 5 wales by two needle swing, and the inelastic fibers in a third guide bar are knitted course by course, by reciprocating in Atlas knitting over 5 wales by two needle swing in a different direction from the inelastic fibers.

* * * * *